US005688332A

United States Patent [19]

Cha

[11] Patent Number: 5,688,332

[45] Date of Patent: Nov. 18, 1997

[54] PIPE CLEANING USING MICROWAVE ENERGY

[76] Inventor: Chang Yul Cha, 3807 Reynolds St., Laramie, Wyo. 82070

[21] Appl. No.: 572,831

[22] Filed: Dec. 14, 1995

[51] Int. Cl.[6] ..... B08B 7/00

[52] U.S. Cl. ..... 134/1.1; 134/22.11

[58] Field of Search ..... 134/1, 1.1, 19, 134/22.11; 204/157.15, 157.43

[56] References Cited

U.S. PATENT DOCUMENTS

| | | | |
|---|---|---|---|
| 4,435,374 | 3/1984 | Helm, Jr. | 204/157.43 X |
| 4,545,879 | 10/1985 | Wan et al. | 204/158 R |
| 5,087,272 | 2/1992 | Nixdorf | 55/96 |
| 5,256,265 | 10/1993 | Cha | 204/157.3 |
| 5,277,770 | 1/1994 | Murphy | 204/157.43 |
| 5,423,180 | 6/1995 | Nobue et al. | 60/274 |
| 5,458,742 | 10/1995 | Mueller et al. | 204/157.43 |

OTHER PUBLICATIONS

Southworth, Principles and Applications of Waveguide Transmission, Nostrand 1950.

Kirk–Othmer, Encyclopedia of Chemical Technology, 3rd Ed., Supp. vol., pp. 599–608, Plasma Technology, 1978.

Kirk–Othmer, Encyclopedia of Chemical Technology, 3rd Ed., vol. 15, pp. 494–517, Microwave Technology, 1981.

*Primary Examiner*—Jeffrey Snay
*Assistant Examiner*—Saeed Chaudhry
*Attorney, Agent, or Firm*—John O. Mingle

[57] ABSTRACT

A process is disclosed for cleaning carbonaceous deposited material from the inside of pipes or tubes by utilizing microwave catalysis to dynamically remove such soot-like material as it chemical reacts with oxygen supplied by a sweep gas to form gaseous products. The metallic pipe is converted to a waveguide by the use of appropriate frequencies of microwave energy. The soot-like material is catalyzed by the microwave energy so that any oxygen reactions occur at a relatively low bulk temperature.

5 Claims, 2 Drawing Sheets

PIPE CLEANING USING MICROWAVE ENERGY

BACKGROUND OF INVENTION

1. Field of Invention

The present invention relates to a process using radiofrequency energy to catalyze oxidation chemical reactions involving carbonaceous material deposited inside pipes.

2. Background

Carbonaceous material formed within pipes flowing hydrocarbons, such as fuels, builds up with time and causes inefficiency due to pressure loss as well as acting as a contaminant when the pumped fluid is changed. Such pipe deposits are often associated with soot although this form of material is not a byproduct of incomplete combustion, but still it is black, messy and sometimes "feels" oily because of the large amount of hydrocarbons clinging to the base carbon material. This carbonaceous material will given the common name "soot-like material" or just sometimes "soot."

Over time degradation of hydrocarbon containing fluids being pumped through metallic pipes and tubing produces a fouling effect as this soot builds up. If the pipes are associated with heat exchanger then elevated temperatures often enhance such fouling rates.

Other pipes or ducts where soot-like carbonaceous material is deposited include various exhaust systems.

A common method of cleaning fouled pipes is by acid treatment which besides its expense creates an environmentally difficult residue. Conversely the subject invention produces gaseous products as the result of oxidation which are likely environmentally clean. The exception occurs if known hazardous compounds are present in the fouled pipes.

Quantum radiofrequency (RF) physics is based upon the phenomenon of resonant interaction with matter of electromagnetic radiation in the microwave and RF regions since every atom or molecule can absorb, and thus radiate, electromagnetic waves of various wavelengths. The rotational and vibrational frequencies of the electrons represent the most important frequency range. The electromagnetic frequency spectrum is conveniently divided into ultrasonic, microwave, and optical regions. The microwave region runs from 300 Mhz (megahertz) to 300 GHz (gigahertz) and encompasses frequencies used for much communication equipment. A treatise of such information is presented by Southworth, *Principles and Applications of Waveguide Transmission,* Nostrand, N.Y., 1950, which is herewith incorporated by reference.

Often the term microwaves or microwave energy is applied to a broad range of radiofrequency energies particularly with respect to the common frequencies, 915 MHz and 2450 MHz. The former is often employed in industrial heating applications while the latter is the frequency of the common household microwave oven and therefore represents a good frequency to excite water molecules.

The absorption of microwaves by the energy bands, particularly the vibrational energy levels, of the atoms or molecules results in the thermal activation of the nonplasma material and the excitation of valence electrons. The nonplasma nature of these interactions is important for a separate and distinct form of heating employs plasma formed by arc conditions of a high temperature, often more than 3000° F., and at much reduced pressures or vacuum conditions. For instance, refer to Kirk-Othmer, *Encyclopedia of Chemical Technology,* 3rd Edition, Supplementary Volume, pages 599–608, Plasma Technology. In microwave technology, as applied in the subject invention, neither condition is present and therefore no plasmas are formed.

These microwaves lower the effective activation energy required for desirable chemical reactions since they can act locally on a microscopic scale by exciting electrons of a specific atom in contrast to normal global heating by raising the bulk temperature. Further this microscopic interaction is favored by polar molecules whose electrons become locally excited leading to high chemical activity; however, nonpolar molecules adjacent to such polar molecules are affected to a much lesser extent. An example is the heating of polar water molecules in a common household microwave oven where the container is of nonpolar material, that is, microwave-passing, and stays relatively cool.

A polar material interacts with microwaves readily and rapidly degrades its effective penetrating power. This aspect is employed in waveguides for microwave transmission since the waveguide transmits the energy along the skin of the guide; therefore, the guide is hollow. The cross-sectional dimensions of a rectangular waveguide must be in the order of a half wave length in order for it to contain the electromagnetic fields properly. Pipes can serve as reasonable waveguides if their diameter is RF-matched properly to such wave length. For instance, the cut-off frequencies for ½", 1" and 2.82" inside pipe diameters are 13.83 GHz, 6.91 GHz and 2.45 GHz respectively. Such a hollow waveguide contains a substantially uniform radiofrequency energy field that is utilized for microwave irradiations.

As used above microwaves are often referred to as a form of catalysis when applied to chemical reaction rates. For instance, see Kirk-Othmer, *Encyclopedia of Chemical Technology,* 3rd Edition, Volume 15, pages 494–517, Microwave Technology.

Related United States patents using microwaves include:

| U.S. Pat. No. | Inventor | Year |
|---|---|---|
| 4,545,879 | Wan et al. | 1985 |
| 5,087,272 | Nixdorf | 1992 |
| 5,256,265 | Cha | 1993 |
| 5,277,770 | Murphy | 1994 |
| 5,423,180 | Nobue et al. | 1995 |

Referring to the above list, Wan et al. disclose employing microwave heating to desulphurize pulverized petroleum pitch using a ferromagnetic catalyst. In contrast the subject invention employs microwave catalysis and not a metallic catalyst.

Nixdorf discloses using a filter containing silicon carbide whiskers to remove particulate matter from a gas stream and then clean said filter with microwave heating. The subject invention is not a filter.

Cha discloses removing NO in a homogeneous mixture with soot and oxygen carried out in a waveguide reactor as a laboratory experiment. In contrast the subject invention is not designed to remove a particular compound from a gas stream.

Murphy discloses reactivating plasma initiators using microwaves in the presence of oxygen which is checked by a methane conversion reaction, where such plasma initiators are, or contain, metallic catalysts. The subject invention has no connection with the plasma regime of gases and contains no metallic catalysts.

Nobue et al. disclose a filter regeneration system for an internal combustion engine using microwaves. The subject invention is not a filter.

SUMMARY OF INVENTION

The objectives of the present invention include overcoming the above-mentioned deficiencies in the prior art. The subject invention utilizes microwave catalysis to dynamically remove such carbonaceous material from the inside of pipes or tubes as it chemical reacts with oxygen to form gaseous products. The metallic pipe is converted to a waveguide for the microwave energy. The soot-like material is catalyzed by the microwave energy so that any oxygen reactions occur at a relatively low bulk temperature.

DETAILED DESCRIPTION OF INVENTION

Figures 1, 1A:
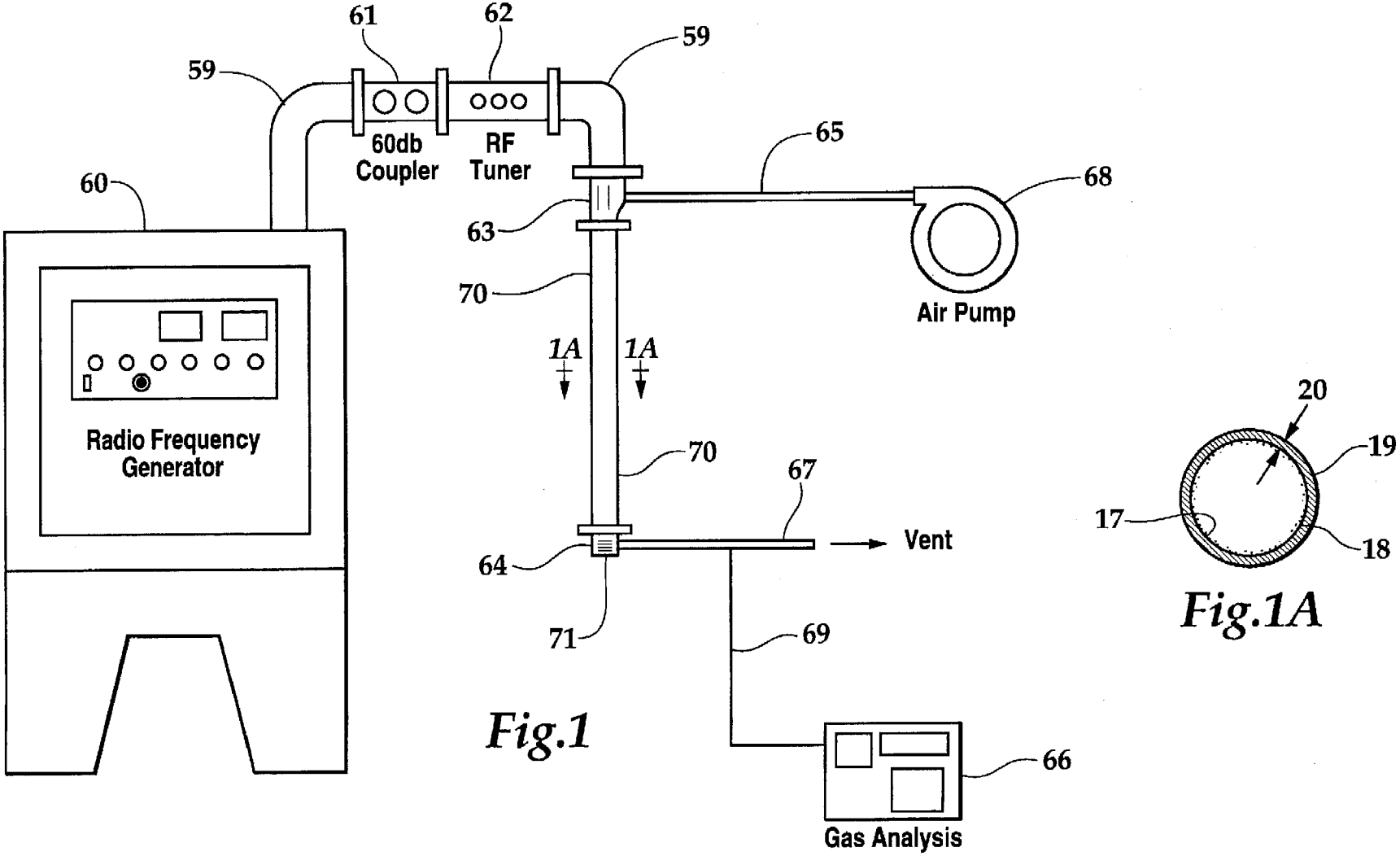
FIG. 1 shows the experimental system to clean pipes using radiofrequency or microwave energy.

Microwaves are a versatile form of energy that is applicable to enhance chemical reactions since the energy is locally applied by its vibrational absorption by polar molecules and does not produce plasma conditions. Particularly reactions that proceed by free-radical mechanisms are often enhanced to higher rates because their initial equilibrium thermodynamics is unfavorable. A second class of enhanced reactions are those whose reaction kinetics appear unfavorable at desirable bulk temperature conditions, such as about 300° F.

Radiofrequency catalysis, particularly in laboratory situations, is performed with char; however, such char is formed into large bed particles and exposed to various gases. Char is a form of pyrolyric carbon, but is not commonly referred to as soot, and is formed by driving gases from coal in a non oxidizing atmosphere. Common soot is often formed in an oxidizing gas due to incomplete combustion, but also appears on the degradation of hydrocarbons. Since char and soot are both carbonaceous and both contain polar constituents, their equivalency for microwave catalysis is presumed, but is further tested below.

In microwave catalysis the following reaction is common:

$$C+O_2 \text{ - - - (RF) - - - >} CO_2 \quad (1)$$

where - - - (RF) - - - > implies that RF microwave energy catalyzes the reaction to proceed in the direction indicated at a lower temperature than normal burning would transpire. A convenient bulk temperature is 300° F., but temperatures up to 500° F. are often utilized. Periodic microwave energy is often utilized since reaction (1) is highly exothermic and time for cooling is needed.

Equation (1) is shown with oxygen gas; however, for such radiofrequency catalysis involving char or soot only oxygen-containing molecules are required and are conveniently selected from the group consisting of oxygen, carbon monoxide, carbon dioxide, water, and the oxides of nitrogen.

Some tests were conducted to investigate the microwaving properties of soot by putting about 3 inches of soot, usually approximately 2 grams in a quartz tube having a diameter of ¾ inch with a length of 48 inches and positioned within a microwave energy cavity formed by the inside of a rectangular waveguide. Three ceramic layers of fibers, in essence forming ceramic filters, were used to contain the soot, one at the tube top, one at the tube middle, and one at the tube bottom. The upper ceramic filter was a safety trap. With gas flowing often the soot obtained a fluidized state. The RF energy equipment was utilized at a power of 500 watts.

Several runs were made utilizing different gas mixtures with the flow rate usually in the fluidized range for the soot. A nitrogen gas run served as a blank test and indicated the soot contained some oxygen-containing molecules which underwent microwave catalysis reacting with some of the carbon. Another series of runs employed mixtures of air and nitrogen.

Table 1 shows data from these runs concerning the burning of the soot. The percentage of the soot consumed after 30 minutes varied from 16% for the all nitrogen run to 88% for the all air run. Therefore given enough run time with sufficient oxygen present, the soot was completely burnable.

TABLE 1

500 Watt Microwave Catalysis of Soot for 30 Minutes

| Run | $N_2$ (SCFH) | Air (SCFH) | Soot In(gm) | Soot Out(gm) | Consumed (percent) |
|---|---|---|---|---|---|
| 1 | 2.0 | 0.0 | 2.24 | 1.89 | 16 |
| 2 | 1.5 | 0.5 | 2.14 | 1.54 | 28 |
| 3 | 1.0 | 1.0 | 2.29 | 1.37 | 40 |
| 4 | 0.5 | 1.5 | 2.09 | 0.60 | 71 |
| 5 | 0.0 | 2.0 | 2.16 | 0.27 | 88 |

In the subject invention the fouled metallic pipe becomes a waveguide for radiofrequency energy, often called microwave energy or microwaves.

The term "waveguide," as used here and in the claims, means that radiofrequency energy of a given frequency has been applied to a hollow physical metal body so that a match between said frequency and said physical dimensions is such that substantial energy transmission occurs, and at the same time said hollow portion of said physical metal body becomes a microwave cavity. For instance, a standard metal pipe or tube employed as a waveguide requires a microwave energy frequency no smaller than the cutoff frequency in order to fall under the above definition.

This is accomplished by adjusting or tuning the frequency of the microwaves so that the cutoff frequency is appropriate for the pipe size. Southworth, supra, gives such a cutoff frequency for the lowest mode as 1.71 times the inner diameter when gas occupies the pipe. For instance, such cutoff frequencies for ½", 1" and 2.82" inside pipe diameters are 13.83 GHz, 6.91 GHz and 2.45 GHz respectively. This means if one uses 2.45 GHz microwaves a pipe 2.82 inches in inside diameter or larger can perform as a waveguide; however, with pipes larger than 2.82 inches the efficiency of 2.45 GHz microwave transmission is reduced, but it is still often adequate to form a useable microwave cavity. This cutoff information for pipes is correlated by the equation:

$$f_c=6.91/D \quad (2)$$

where $f_c$ is the cutoff frequency in GHz and D is the inner pipe diameter in inches.

Similar cutoff frequencies are available for rectangular waveguides. Information on these cutoff frequencies for various geometries and other information about the operation of waveguides is found in Southworth, supra.

Therefore in conjunction with fouled pipes in this specification and the accompanying claims the expression "converting said pipe to a waveguide by energizing said pipe with radiofrequency energy" means utilizing a frequency for said radiofrequency energy no smaller than the cutoff frequency for said pipe size. In the case where a waveguide already exists, then by definition of a waveguide the frequency of the radiofrequency energy has already been adjusted to no smaller than the cutoff frequency for the dimensions of said waveguide.

FIG. 1 shows the experimental system used to clean test pipes. A standard radiofrequency generator 60 is coupled with standard rectangular waveguides 59 to a 60 db coupler 61 and an RF tuner 62. For these experiments an acceptable frequency of 2.45 GHz was employed at a power of 1000 watts. A transition waveguide 63 coupled the standard rectangular waveguide to the circular pipe 70, and this transition piece also contained an air inlet tube 65 feeding from an air pump 68. Transition waveguide pieces may be determined from Izadian and Izadian, *Microwave Transition Design,* Artech House, Norwood, Mass., 1988, which is herewith incorporated by reference. The circular pipe contained deposited soot 17 as shown in Section A—A where the outer diameter of the pipe 19, the inner diameter 18, and the wall thickness 20 are shown. For the experimental system a nominal five inch schedule 40 pipe was employed with an outer diameter of 5.563", an inner diameter of 5.047", and a wall thickness of 0.258". The circular pipe was capped at the end 71 using a transition piece of waveguide 64 which contained the gas outlet tube 67. The gas outlet tube 67 was sampled by a small tube 69 and bleed into a gas analysis unit 66 where the oxygen concentration was measured.

Figure 2:
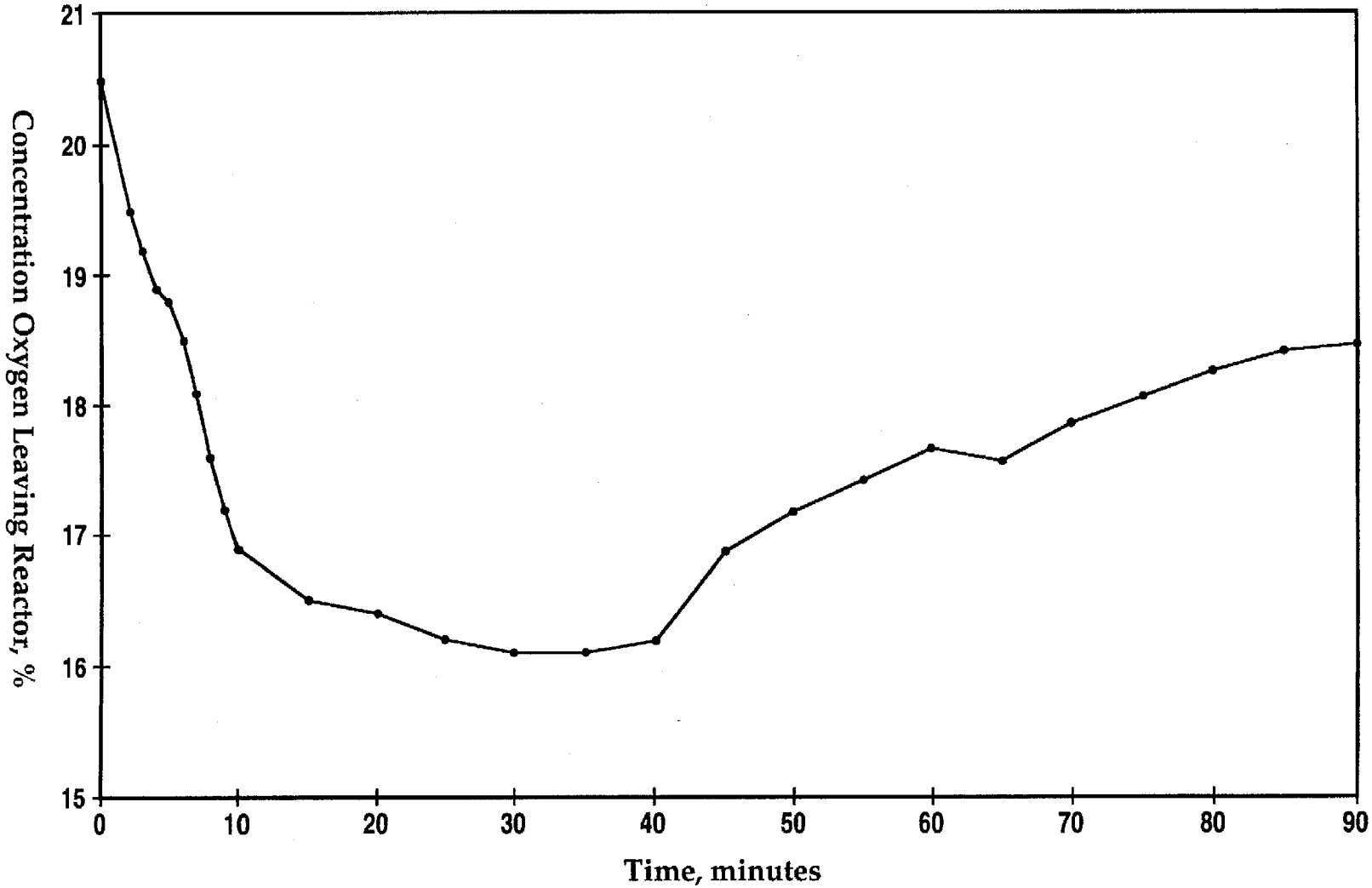
FIG. 2 shows the oxygen concentration during nominal five inch pipe test burn.

To check the performance of the subject invention, a 5.0 inch nominal schedule 40 pipe, about three foot long, was coated with soot from an operating diesel engine for approximately 24 hours. Visual inspection showed a layer of soot deposited on the inside of the pipe. The pipe was converted to a waveguide by the use of 2.45 GHz microwaves, above the cutoff frequency of 1.37 GHz. Room air containing oxygen and some moisture was passed through the pipe. The power level of the microwave energy was not critical, as 1000 watts was employed in this test, but is directly proportional to the time required for soot removal. The gas leaving the pipe was tested for oxygen and the results are presented in FIG. 2. After about 90 minutes the pipe was substantially free of soot as the oxygen content of the sweep gas was slowly approaching that of room air. This indicated that the catalyzing of soot to $CO_2$ in the presence of a gas containing oxygen molecules by microwaves was greatly reduced after 90 minutes since a majority of the soot had reacted and the remaining minor amount of soot had very little surface area to continue the reaction. As FIG. 2 indicated the largest reaction rate occurred at approximately 30 minutes. The bulk temperature of the gas leaving the pipe was consistently below the upper limit of 500° F. and usually below the preferred limit of 300° F.

The foregoing description of the specific embodiments will so fully reveal the general nature of the invention that others can, by applying current knowledge, readily modify and/or adapt for various applications such specific embodiments without departing from the generic concept, and therefore such adaptations or modifications are intended to be comprehended within the meaning and range of equivalents of the disclosed embodiments. It is to be understood that the phraseology or terminology herein is for the purpose of description and not of limitation.

I claim:

1. A process for cleaning a metallic pipe fouled within by carbonaceous material comprising:

passing a gas containing oxygen-containing molecules through said pipe; and converting said pipe to a waveguide by energizing said pipe with radiofrequency energy at a cutoff frequency or above while catalyzing oxidizing reactions between said carbonaceous material and said oxygen-containing molecules.

2. The process according to claim 1 wherein said oxygen-containing molecules further comprise being selected from the group consisting of oxygen, carbon monoxide, carbon dioxide, water, and the oxides of nitrogen.

3. The process according to claim 1 wherein said oxidizing reactions further comprise being carried out at a bulk temperature below about 500° F.

4. The process according to claim 1 wherein said radiofrequency energy further comprises periodic operation.

5. A process for cleaning a metallic pipe fouled within by soot comprising:

passing air through said pipe;

converting said pipe to a waveguide by energizing said pipe with radiofrequency energy at a cutoff frequency or above, wherein the cutoff frequency is calculated from the expression: 6.91/D where D is the inside pipe diameter in inches and the resulting cutoff frequency is expressed in gigahertz, and where the actual frequency employed must be no less than this cutoff frequency;

catalyzing oxidizing reactions between said soot and said air with said radiofrequency energy; and maintaining a bulk temperature below about 500° F.

* * * * *